US009380894B2

(12) United States Patent
Martenson et al.

(10) Patent No.: US 9,380,894 B2
(45) Date of Patent: Jul. 5, 2016

(54) CASTER HAVING REPLACEABLE SHIELDED BEARING

(76) Inventors: Susan Ann Martenson, Eden, UT (US); Christopher Marshall Burke, Eden, UT (US)

( * ) Notice: Subject to any disclaimer, the term of this patent is extended or adjusted under 35 U.S.C. 154(b) by 104 days.

(21) Appl. No.: 13/161,344

(22) Filed: Jun. 15, 2011

(65) Prior Publication Data

US 2011/0302740 A1 Dec. 15, 2011

Related U.S. Application Data

(60) Provisional application No. 61/355,135, filed on Jun. 15, 2010, provisional application No. 61/380,543, filed on Sep. 7, 2010.

(51) Int. Cl.

| | |
|---|---|
| ***B60B 33/00*** | (2006.01) |
| ***A47G 9/02*** | (2006.01) |
| ***A47G 9/00*** | (2006.01) |

(52) U.S. Cl.

CPC ..... *A47G 9/0253* (2013.01); *A47G 9/00* (2013.01); *A47G 9/0284* (2013.01); *Y10T 16/1847* (2015.01); *Y10T 29/4973* (2015.01)

(58) Field of Classification Search

CPC ..... B60B 33/0002; B60B 33/00028; B60B 33/0042; B60B 33/0049; B60B 337/00; B60B 33/0057; B60B 33/068; B60B 33/0073; B60B 33/0021

USPC ..... 16/20–23; 384/903

See application file for complete search history.

(56) References Cited

U.S. PATENT DOCUMENTS

| | | | | | |
|---|---|---|---|---|---|
| 2,595,453 | A | | 5/1952 | Gilmore | |
| 2,631,329 | A | * | 3/1953 | McKean | 16/21 |
| 3,071,388 | A | | 1/1963 | Ulinski | |
| 3,283,358 | A | * | 11/1966 | Merriam | B60B 33/0002 16/18 R |
| 3,733,648 | A | * | 5/1973 | Asberg et al. | 16/21 |
| 3,837,039 | A | * | 9/1974 | Rehrig | B60B 33/0002 16/20 |
| 3,901,569 | A | * | 8/1975 | Uehara | 384/622 |
| 4,364,615 | A | * | 12/1982 | Euler | 384/517 |
| 4,494,271 | A | | 1/1985 | Perlin et al. | |
| 5,007,746 | A | * | 4/1991 | Matzelle et al. | 384/420 |
| 5,059,844 | A | * | 10/1991 | Anstine | 310/90 |
| 5,305,496 | A | | 4/1994 | Gagnon | |
| 5,390,393 | A | * | 2/1995 | Reppert | B60B 33/0002 16/21 |
| 5,462,369 | A | * | 10/1995 | Layne et al. | 384/538 |
| 5,809,612 | A | * | 9/1998 | Finch | B60B 33/0007 16/21 |

(Continued)

FOREIGN PATENT DOCUMENTS

| | | | | |
|---|---|---|---|---|
| GB | 2274983 | A * | 8/1994 | B60B 33/00 |

*Primary Examiner* — Victor Batson
*Assistant Examiner* — Matthew Sullivan
(74) *Attorney, Agent, or Firm* — David W. Barman

(57) ABSTRACT

A caster includes a yoke for retaining a wheel, a bearing housing connected to the yoke and a replaceable shielded bearing occupying the bearing housing. The inner wall of the bearing housing is provided with a groove into which a retaining ring may be inserted to prevent the shielded bearing from escaping. A caster mounting assembly having a connecting member which passes through a central opening of the shielded bearing is configured to connect the yoke and the bearing housing to a rollable article, such as chair or table. In the event that the shielded bearing needs to be replaced, the caster may be disassembled, the retaining ring removed from the groove, a new shielded bearing substituted for the old shield bearing, the retaining ring replaced in the groove, and the caster reassembled.

17 Claims, 5 Drawing Sheets

(56) References Cited

U.S. PATENT DOCUMENTS 6,047,439 A * 4/2000 Stearn ..... 16/30
6,318,900 B1 * 11/2001 Bere et al. ..... 384/535
6,463,624 B1 10/2002 Su
6,502,280 B2 1/2003 Looker
6,666,583 B2 * 12/2003 Nieman et al. ..... 384/537
8,087,127 B2 * 1/2012 Dayt ..... 16/47
2003/0061681 A1 * 4/2003 Plate ..... B60B 33/0002 16/19
2004/0060149 A1 * 4/2004 Chang ..... 16/20

* cited by examiner

CASTER HAVING REPLACEABLE SHIELDED BEARING

RELATED APPLICATIONS

The present invention claims priority to U.S. Provisional patent application No. 61/355,135, filed Jun. 15, 2010, and also to U.S. Provisional patent application No. 61/380,543, filed Sep. 7, 2010.

BACKGROUND

The present invention is directed to a caster for a rollable article such as a chair, the caster having a replaceable shielded bearing.

SUMMARY

In one aspect, the invention is directed to a caster for a rollable article such as a chair. The caster includes a yoke having a wheel mounted thereto and a bearing housing fixed to an upper portion of the yoke. The bearing housing comprises an outer wall, an upper rim and an inner wall. A circumferential groove is formed in the inner wall proximate the upper rim. A replacement shielded bearing having a central opening formed therein is located in the bearing housing, and a retaining ring occupies the groove to prevent the shielded bearing from escaping the bearing housing. The caster further include a mounting assembly configured to connect the yoke and the bearing housing to the rollable article, the mounting assembly including a connecting member having a portion that passes through the central opening of the shielded bearing.

In another aspect, the invention is directed to a method of repairing a caster having a worn or damaged shielded bearing. The method comprises: disassembling a caster mounting assembly of a caster; removing a retaining ring from a groove of a bearing housing; replacing the worn or damaged shielded bearing with a new shielded bearing; inserting the retaining ring back into the groove; and reassembling the caster mounting assembly.

In yet another aspect, the invention is directed to a caster fork assembly comprising: a yoke having a wheel mounted thereto and a bearing housing fixed to an upper portion of the yoke. The baring housing comprises an outer wall, an upper rim and an inner wall; and a circumferential groove formed in the inner wall proximate the upper rim. The bearing housing also has a lower rim and the bearing housing has a lower rim; and the yoke comprises a pair of yoke sides connected to one another by the lower rim of the bearing housing.

In still another aspect, the invention is directed to a first kit comprising some of the aforementioned components. A second kit comprising the remaining aforementioned components may be manufactured and combined with the first kit.

DETAILED DESCRIPTION

Figure 1:
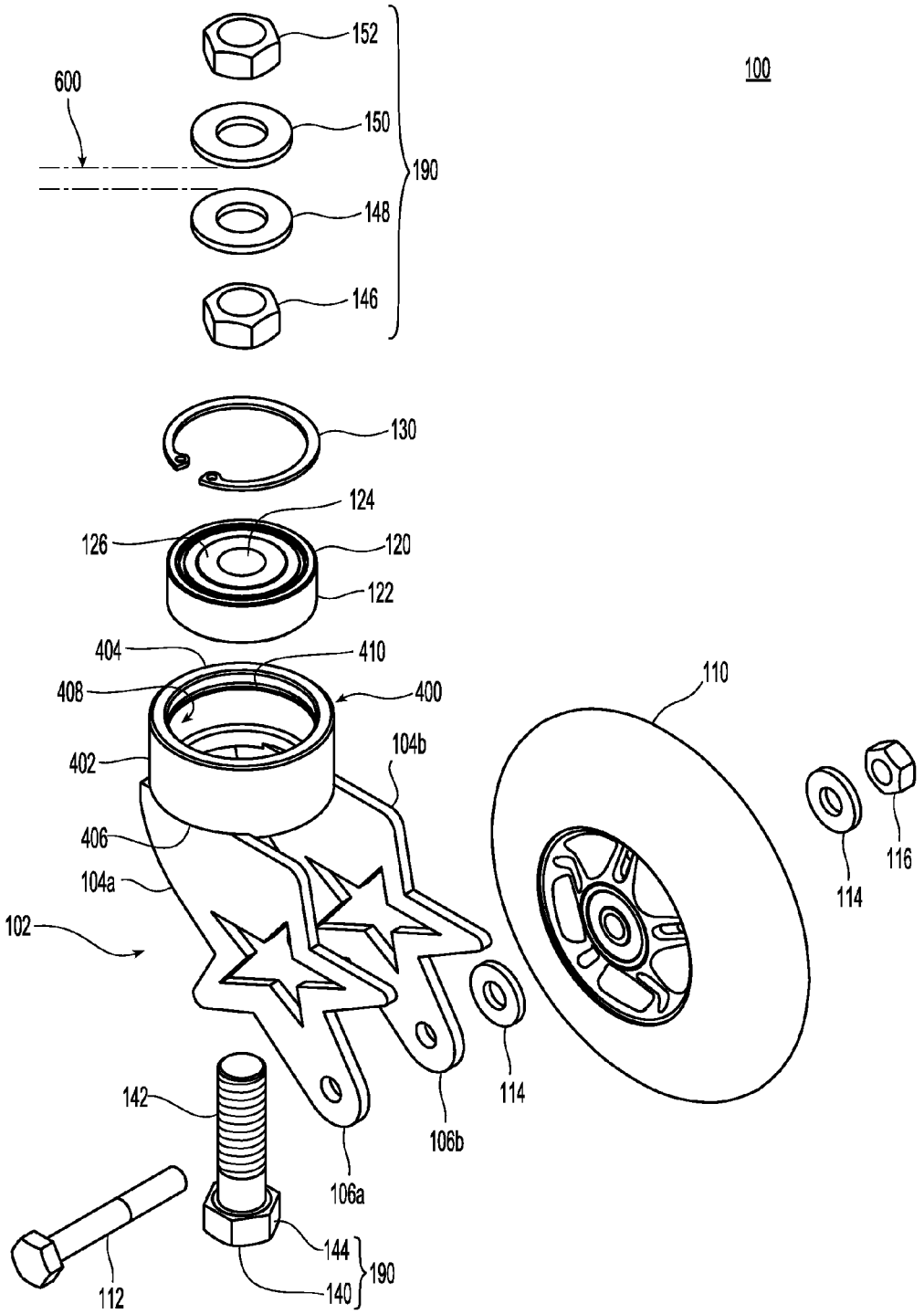
FIG. 1 shows an exploded view of one embodiment of a caster in accordance with a first embodiment of the present invention.

FIG. 1 shows an exploded view of a caster 100 in accordance with one embodiment of the present invention. Caster 100 includes a caster yoke 102 having a pair of yoke sides 104*a*, 104*b*. A wheel 110 is retained by the caster yoke 102 at the latter's spaced apart lower side portions 106*a*, 106*b*, by means of wheel bolt 112, washers 114 and wheel retaining nut 116 engaged to the wheel bolt 112. In some embodiments, the wheel is a "crown-point" wheel (i.e., has a ground contact surface comprising a rounded cross-section, rather than a flat cross-section).

Figure 5:
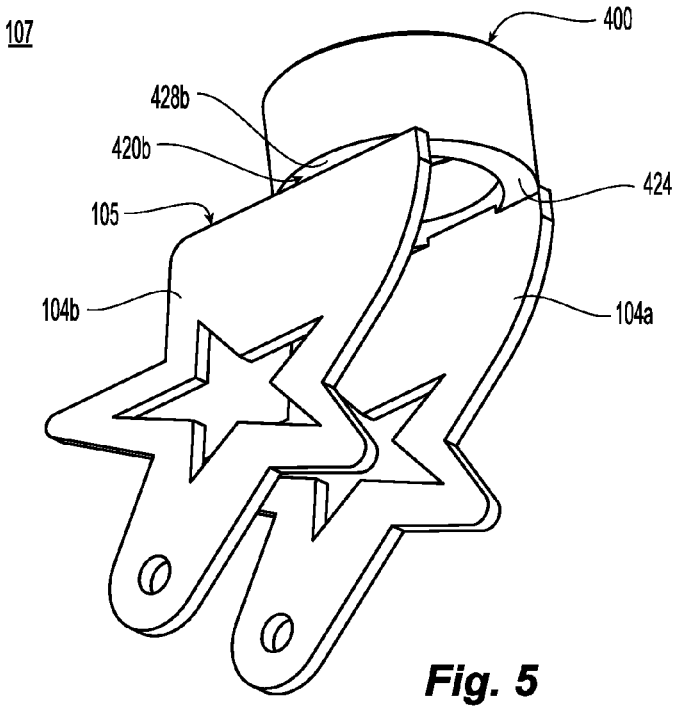
FIG. 5 shows a bottom perspective view of the yoke in combination with the bearing housing.

In some embodiments, and as seen in FIG. 5, the yoke sides 104*a*, 104*b* may be connected to one another at a top portion thereof by a lower rim 404 of a bearing housing 400. In such case, the yoke sides 104*a*, 104*b* may be welded, brazed or otherwise permanently fixed to the lower rim 404 to the bearing housing 400.

In other embodiments, the top portions of the yoke sides 104*a*, 104*b* may be connected to one another by a connecting strip formed of the same material as the yoke sides. In such case, the yoke sides and connecting material may be formed by stamping a flat metal sheet to form a yoke blank and then bending the strip-connected yoke sides 104*a*, 104*b* using a mandrel in a known manner. An opening may then be formed in the connecting strip to accommodate a bolt, pin or other fastener, as described further below, either before or after a housing affixed to the yoke to accommodate the shielded bearing, also as discussed further below.

FIGS. 4A-4E shows one embodiment of a bearing housing 400. The bearing housing 400 may have a generally cylindrical outer wall 402, a lower rim 404, an upper rim 406 and an inner wall 408 defining a passage through the bearing housing 400. Provided on the inner wall 408 of the bearing housing, proximate the upper rim 406, is a circumferential groove 410 configure to accommodate a retaining ring 130.

The inner wall 408 of the bearing housing 400 may be provided with a circumferentially extending step 412 proximate the lower rim 404. The step 412 projects in a radially inward direction of the bearing housing 400. The step 412 is configured to support a bottom periphery of a cylindrical shielded bearing 120 thereon. Thus, the inner wall 408 of the bearing housing 400 may be considered to be a stepped inner wall. Between the step 412 and the lower rim 404, the inner wall 408 has a reduced diameter lower portion 414, whose diameter is smaller than that of the upper portion 406 of the inner wall 408.

The lower rim 404, in a side view thereof, is stepped, having two spaced apart cutouts 420*a*, 420*b* formed therein, resulting in two spaced apart raised sections 422, 424. Each raised section 422, 424 is defined between two parallel step portions 426*a*, 426*b*. Meanwhile, cutout 420*a* is defined by two collinear step portions 420*a* while cutout 420*b* is defined between two other collinear step portions 420*b*, the two collinear step portions 420*a* being generally parallel to the two collinear step portions 420*b*. Each cutout 420*a*, 420*b* has a downwardly facing corresponding abutment surface 428*a*, 428*b*.

FIG. 5 shows one embodiment of how the yoke 102 may be constructed from the yoke sides 104*a*, 104*b* and the bearing housing. As seen in FIG. 5, the upper surface 105 of each yoke side 104*a*, 104*b* is in abutment with a downwardly facing abutment surface 428*a*, 428*b* of a corresponding cutout 420*a*, 420*b* formed in the lower rim 404 of the bearing housing. As stated above, the upper surface 105 of each yoke side 104*a*, 104*b* may be welded, brazed or otherwise permanently attached to the lower rim 404 of the bearing housing 400.

In the assembled caster, a shielded bearing 120 is located in the bearing housing 400, and the retaining ring 130 occupies the circumferential groove 410 to keep the shielded bearing 120 in place. The shielded bearing 120 may be a commercially available bearing having a generally cylindrical outer surface 122, a central opening 124, a generally annular top surface 126 surrounding the central opening 124 and a similarly annular bottom surface also surrounding the central opening 124 (and hidden from view in the figures). The shielded bearing 120 is selected to have an appropriate size and ABEC designation in light of its intended use. In one embodiment, the shielded bearing 120 has an ABEC-5 designation, a 1.375 inch OD outer surface and a 0.437 inch ID central opening 124.

In the embodiment seen in FIG. 1, the caster 100 is mounted to a horizontally extending leg 600 (shown in phantom in FIG. 1) of a chair or other piece of furniture, via the former's caster mounting assembly. As seen in FIG. 1, the caster mounting assembly 190 includes a bottom bolt 140, a lower nut 146 and a lower washer 146. The bottom bolt 140 includes a threaded bolt shaft 142 connected to a bolt head 144. In the assembled caster 100, the bolt head 144 can abut the bottom surface of the shielded bearing 120 which, as stated above, is kept in position by the retaining ring 130. The lower nut 146 and lower washer 148 are mounted on the threaded bolt shaft 142. In some embodiments, the lower nut 146 may abut the top surface 126 of the shielded bearing 120, thereby serving as a spacer 146, while the lower washer 148 may abut an underside of the leg tube 600. The far end of the threaded bolt shaft 142 may pass through the leg tube 600 and be affixed thereto via upper washer 150 and upper nut 152.

Figure 2:
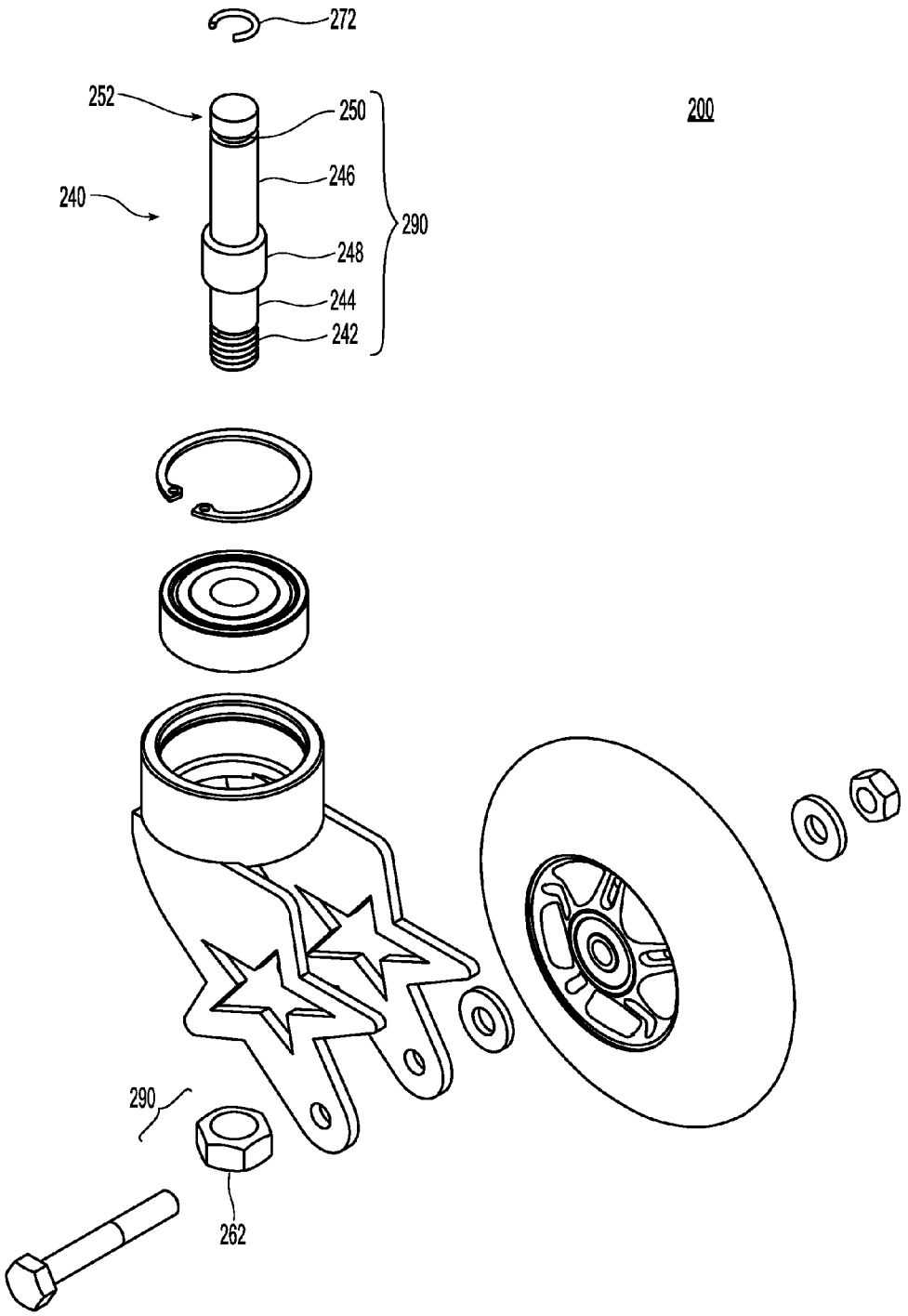
FIG. 2 shows an exploded view of one embodiment of a caster in accordance with a second embodiment of the present invention.

The caster 200 seen in FIG. 2 is generally similar to the caster 100 of FIG. 1 except for the caster mounting assembly. Therefore, the components in caster 200 which are identical to those in caster have not been labeled.

As seen in FIG. 2, the caster mounting assembly 290 includes a caster pin 240 having, at lower end thereof, a lower threaded portion 242 which passes through the central opening 124 of the shielded bearing 120 and threadingly engages a retaining nut 262 located below the shielded bearing 120.

In addition to its lower threaded portion 242, the caster pin 240 includes a lower shaft portion 244, an upper shaft portion 246 and an enlarged spacer portion 248 between the lower shaft portion 244 and the upper shaft portion 246. The enlarged spacer portion 248 has the largest diameter of any portion of the caster pin 240. The caster pin 240 is provided with a narrowed neck portion 250 proximate its upper end 252. The narrowed neck portion 250 is configured to receive a grip ring 272. The caster 200 thus is mounted to a chair or other piece of furniture by insertion of the caster pin's upper end 252 into a suitable aperture configured to receive and retain the caster pin 240.

In the assembled caster 200, the retaining nut 262 may be in abutment with the bottom surface of the shielded bearing 120. And in some embodiments, the spacer portion 248 may have a lower surface thereof abut the top surface 126 of the shielded bearing 120.

Figure 3:
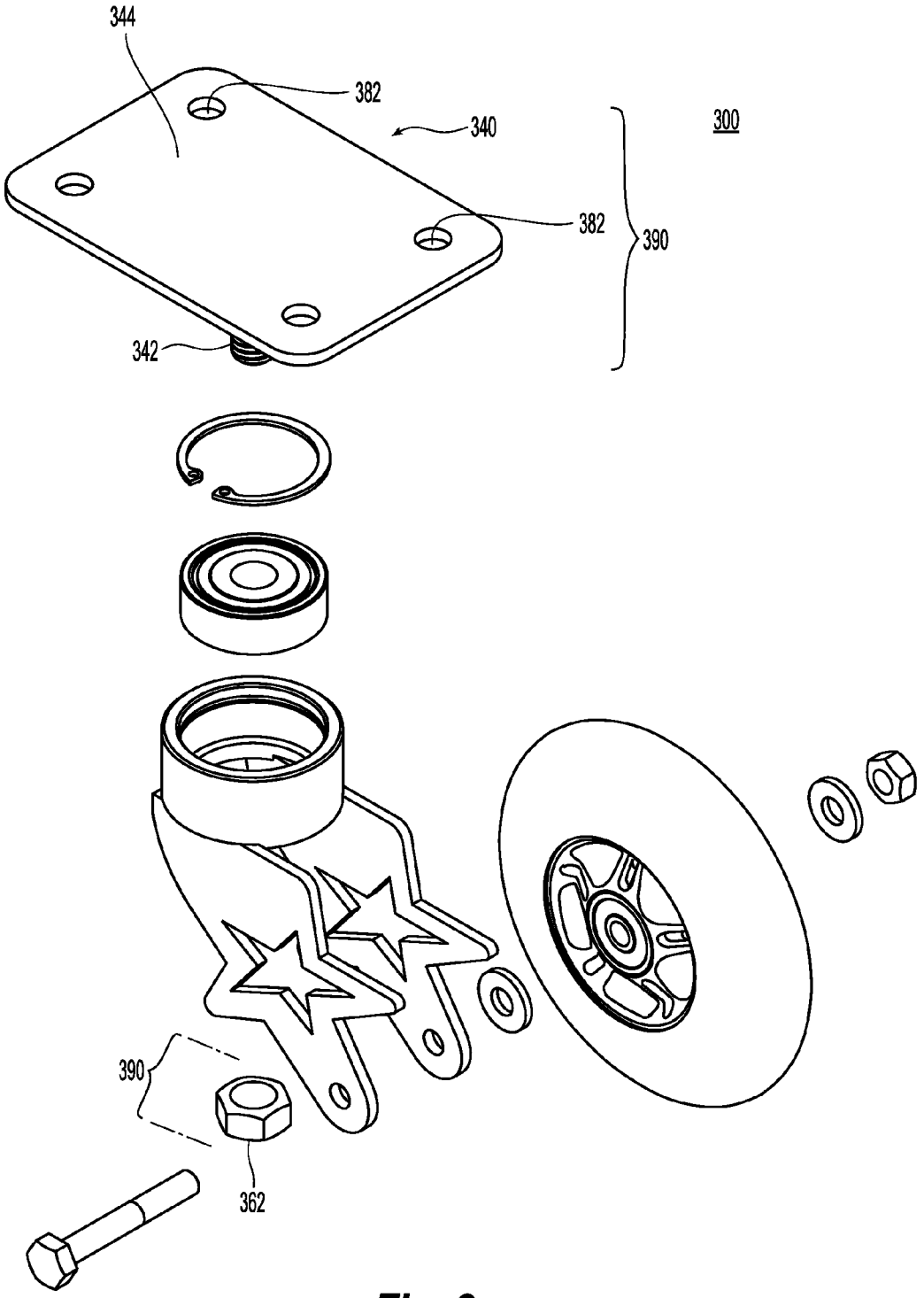
FIG. 3 shows an exploded view of one embodiment of a caster in accordance with a third embodiment of the present invention.
Figure 4A:
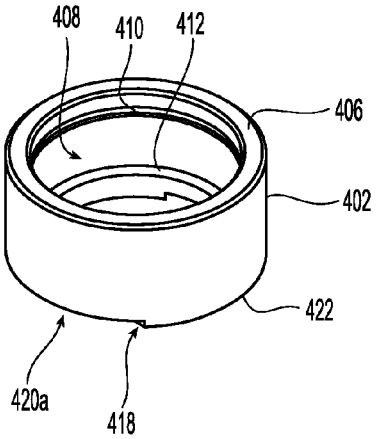
FIG. 4A shows a perspective view of the bearing housing.
Figure 4B:
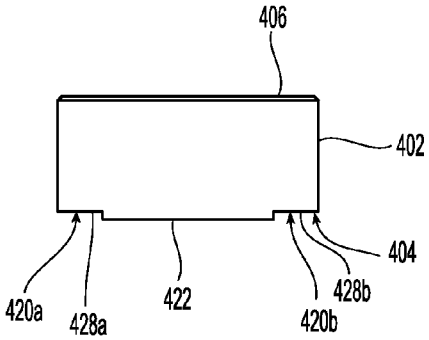
FIG. 4B shows a side view of the bearing housing.
Figure 4C:
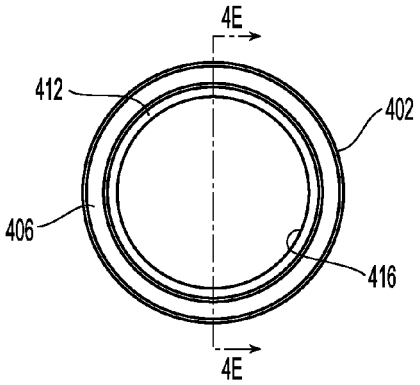
FIG. 4C shows a top view of the bearing housing.
Figure 4D:
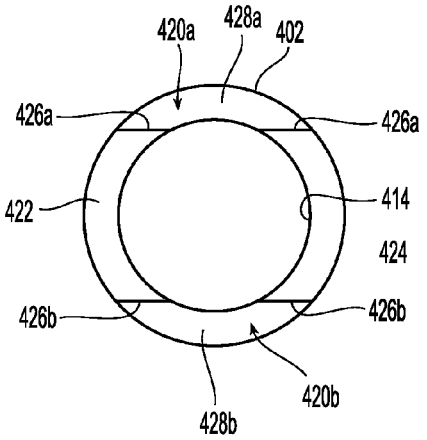
FIG. 4D shows a bottom view of the bearing housing.
Figure 4E:
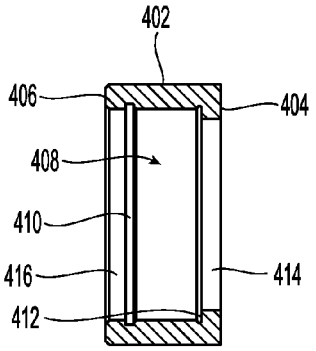
FIG. 4E shows a cross-sectional view of the FIG. 4C taken along line 4E-4E.

The caster 300 seen in FIG. 3 is generally similar to the caster 100 of FIG. 1 and the caster 200 of FIG. 2, except for the caster mounting assembly. Therefore, the components in caster 300 which are identical to those in casters 100 and 300 have not been labeled.

As seen in FIG. 3, the caster mounting assembly 390 includes a bolt-on type base plate 340. In some embodiments, the base plate 340 is made of steel. The base plate 340 includes a threaded shaft 342 projecting from its underside and a plate member 344 provided with a plurality of bolt holes 382.

Figure 6A:
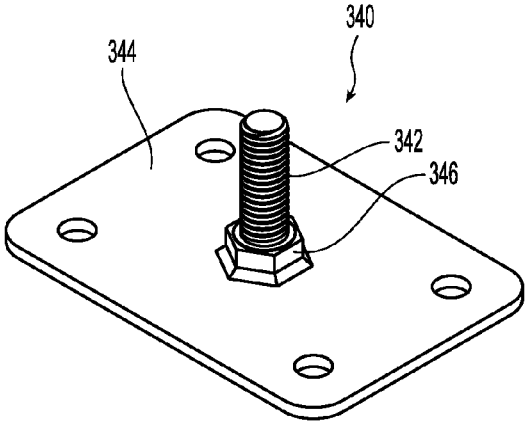
FIG. 6A shows a bottom perspective view of the base plate seen in FIG. 3
Figure 6B:
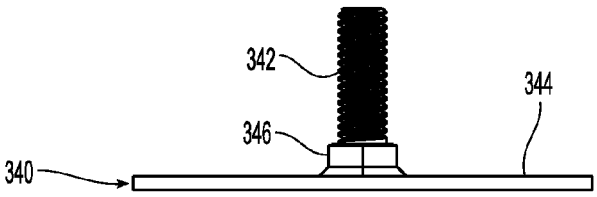
FIG. 6B shows a side view of the base plate seen in FIG. 3.

In the assembled caster 300, the threaded shaft 342 passes through the central opening 124 of the shielded bearing 120 and threadingly engages a retaining nut 362 located below the shielded bearing 120. In the assembled caster 300, the retaining nut 362 can be in abutment with the bottom surface of the shielded bearing 120. As best seen in FIGS. 6A and 6B, the threaded shaft 342 may be provided near its base with a spacer 346. The spacer 346 may be configured to abut the top surface 126 of the shielded bearing 120. In some embodiments, the spacer 346 may have one-piece unitary construction with the threaded shaft 342 while in other embodiments the spacer 346 may be in the form of a nut threadingly engaged to, and located at the base of, the threaded shaft 342.

From the foregoing, it should be evident that the fork assembly 107 comprising the yoke 102 having the housing 400 affixed thereto, the shielded bearing 120 and retaining ring 130 are common to all caster embodiments. Thus, a manufacturer, supplier or retailer may provide a first kit comprising: (a) a fork assembly 107 including the yoke 102 having the bearing housing 400 affixed thereto; (b) a retaining ring 130; and (c) the shielded bearing 120, and may further provide a second kit comprising one of the caster mounting assemblies 190, 290 or 390. A variation of this might be to provide a first kit comprising just the fork assembly 107 and the retaining ring, and a second kit comprising any one of the caster mounting assemblies 190, 290 or 390, with the shielded bearing being sold separately. Thus, a manufacturer, supplier or retailer need not produce and/or carry all three embodiments of fully assembled casters 100, 200, 300, but instead may only carry the aforementioned kits and/or individual components thereof.

Furthermore, a caster 100, 200, 300 in accordance with the present invention is amenable to repair in the event of damage to one or more of its components. For instance, if the shielded bearing 120 is worn or damaged, one may disassemble the caster mounting assembly, remove the retaining ring from the groove, replace the old shielded bearing with a new one, insert the retaining ring back into the groove, and reassemble the caster mounting assembly. Replacement of other components may also be performed, thereby obviating the need to toss out the entire caster in the event that a single component is worn or damaged.

The foregoing disclosure provides illustrative embodiments of the invention and is not intended to be limiting. It should be understood that modifications of the disclosed embodiments are possible within the spirit and scope of the invention, and the invention should be construed to encompass such modifications.

What is claimed is:

1. A caster comprising: a yoke having a wheel mounted thereto; a bearing housing fixed to an upper portion of the yoke, the bearing housing comprising: an outer wall, an upper rim and an inner wall, wherein the inner wall of the bearing housing is stepped; and a circumferential groove formed in the inner wall proximate the upper rim; a replaceable shielded bearing located in the bearing housing, the caster configured with the shielded bearing supported by at least one step formed on the inner wall, the replaceable shielded bearing having a central opening formed therein; a retaining ring occupying the groove and configured to prevent the shielded bearing from escaping the bearing housing; and a mounting assembly configured to disassemble and reassemble and further configured to connect the yoke and the bearing housing to a rollable article, the mounting assembly consisting of distinct alternative mounting assemblies comprised of: an upwardly projecting threaded pin, a pin having each of a threaded lower portion and a grip ring upper portion; or a plate having a downwardly protruding threaded pin, whereby said assembly forms a connecting member having a portion that passes through the central opening of the shielded bearing and further wherein said caster is configured to be used with at least two of said alternate mounting assembly options and utilizes one of said distinct alternative mounting assemblies at a time for mounting sad yoke and sad bearing housing to said rollable article.

2. The caster according to claim 1, wherein: the wheel is a high-crown wheel.

3. The caster according to claim 1, wherein: the bearing housing has a lower rim; and the yoke comprises a pair of yoke sides connected to one another by the lower rim of the bearing housing.

4. The caster according to claim 3, wherein: the lower rim of the bearing housing is provided with a pair of spaced apart cutouts; and upper surfaces of the yoke sides are attached to the lower rim at abutment surfaces formed in the cutouts.

5. The caster according to claim 4, wherein: the upper surfaces of the yoke sides are welded or brazed to the abutment surfaces formed in the cutouts.

6. The caster according to claim 1, wherein: the connecting member comprises a caster pin having a lower threaded portion which passes through the central opening of the shielded bearing and threadingly engages a retaining nut located below the shielded bearing.

7. The caster according to claim 6, wherein: the retaining nut is in abutment with a bottom surface of the shielded bearing.

8. The caster according to claim 7, wherein: the caster pin has an enlarged spacer portion which is in abutment with an upper surface of the shielded bearing.

9. The caster according to claim 6, wherein: the caster pin has an upper end provided with a groove and a grip ring.

10. The caster according to claim 1, wherein: the connecting member comprises a threaded shaft of a mounting plate, which threaded shaft passes through the central opening of the shielded bearing and threadingly engages a retaining nut located below the shielded bearing.

11. The caster according to claim 10, wherein: the retaining nut is in abutment with a bottom surface of the shielded bearing.

12. The caster according to claim 11, wherein: the mounting assembly further comprises a second nut in abutment with an upper surface of the shielded bearing.

13. The caster according to claim 1, wherein: the connecting member comprises a bolt having a bolt shaft which passes through the central opening of the shielded bearing, the bolt also having a bolt head; and the bolt head is located below the shielded bearing.

14. The caster according to claim 13, wherein: The bolt head is in abutment with a bottom surface of the shielded bearing.

15. The caster according to claim 14, wherein: the mounting assembly further comprises a nut in abutment with an upper surface of the shielded bearing.

16. A first caster assembly kit, comprising: a yoke having a wheel mounted thereto; a bearing housing fixed to an upper portion of the yoke, the bearing housing comprising: an outer wall, an upper rim and an inner wall, wherein the inner wall of the bearing housing is stepped; and a circumferential groove formed in the inner wall proximate the upper rim; a replaceable shielded bearing located in the bearing housing, the caster configured with the shielded bearing supported by at least one step formed on the inner wall, the replaceable shielded bearing having a central opening formed therein; a retaining ring occupying the groove and configured to prevent the shielded bearing from escaping the bearing housing; and a mounting assembly configured to disassemble and reassemble and further configured to connect the yoke and the bearing housing to a rollable article, the mounting assembly consisting of distinct alternative mounting assemblies comprised of; an upwardly projecting threaded pin, a pin having each of a threaded lower portion and a grip ring upper portion; or a plate having a downwardly protruding threaded pin, whereby said assembly forms a connecting member having a portion that passes through the central opening of the shielded bearing and further wherein said caster is configured to be used with at least two of said alternate mounting assembly options and utilizes one of said distinct alternative mounting assemblies at a time for mounting said yoke and said bearing housing to said rollable article.

17. The first caster assembly kit in accordance with claim 16, in combination with a second caster assembly kit, wherein the second caster assembly kit comprises: a mounting assembly configured to connect the yoke and the bearing housing to a rollable article, the mounting assembly including a connecting member having a portion configured to pass through the central opening of the shielded bearing, upon assembling a caster from the first caster assembly kit and the second caster assembly kit.

* * * * *